United States Patent [19]

Alexander

[11] 4,223,555

[45] Sep. 23, 1980

[54] FASTENER TOOLS

[75] Inventor: Robert H. Alexander, Columbia, S.C.

[73] Assignee: Rockwell International Corporation, Pittsburgh, Pa.

[21] Appl. No.: 404,689

[22] Filed: Oct. 9, 1973

[51] Int. Cl.[3] ..... B25B 23/14

[52] U.S. Cl. ..... 73/139; 73/136 R

[58] Field of Search ..... 73/136 R, 139; 173/12

[56] References Cited

U.S. PATENT DOCUMENTS

| | | | |
|---|---|---|---|
| 3,190,113 | 6/1965 | Richmond | 73/136 R |
| 3,230,762 | 1/1966 | Doran | 73/133 R |
| 3,385,136 | 5/1968 | Berry et al. | 73/136 X |
| 3,596,718 | 8/1971 | Fish et al. | 173/12 |
| 3,613,853 | 10/1971 | Linthicum et al. | 173/12 X |
| 3,710,874 | 1/1973 | Seccombe et al. | 173/12 |
| 3,834,467 | 9/1974 | Fuchs | 173/12 |
| 3,858,444 | 1/1975 | Wallace | 73/139 |
| 3,920,082 | 11/1975 | Dudek | 173/12 |

*Primary Examiner*—Charles A. Ruehl

*Attorney, Agent, or Firm*—Le Blanc, Nolan, Shur & Nies

[57] ABSTRACT

Fastener tools having a rotatable output member to which a fastener engageable component can be attached, a motor for rotating the output member, and a transducer for measuring the torques to which fasteners are tightened by the tool.

15 Claims, 5 Drawing Figures

FASTENER TOOLS

This invention relates to tools for tightening fasteners and, more specifically, to tools of this character equipped with a novel, improved arrangement for providing an indication or measurement of the torques to which fasteners are tightened.

In recent years emphasis has been placed in different industries on greater accuracy in tightening fasteners to design torques in various assembly operations. Tool manufacturers have responded by developing fastener tools inherently capable of tightening fasteners to closer tolerances and, also, by developing fastener tools capable of measuring the torques to which fasteners are actually tightened. The measurements are used to insure that the tool is operating within allowable tolerances or to control the operation of the tool or for both purposes.

The primary object of the present invention resides in the provision of novel, improved tools with both of the capabilities just described—that is, in the provision of fastener tools which are inherently capable of tightening fasteners within narrow tolerances and which, also, are capable of measuring the torques to which fasteners are tightened.

A number of fastener tools capable of providing torque measurements have heretofore been proposed. U.S. Pat. No. 2,365,564 for Torque Measuring Device For Shafts; U.S. Pat. No. 2,428,012 for Torque Meter; U.S. Pat. No. 2,531,228 for Torque Measuring System; U.S. Pat. No. 2,957,342 for Machine For Measuring Torque and Tension; U.S. Pat. No. 3,354,705 for Torque Tension Testing Apparatus and Method For Nut-Bolt Assemblies; U.S. Pat. No. 3,464,503 for Measuring Device For Impact Tool; U.S. Pat. No. 3,572,447 for Torque Measuring System For Impact Wrench; and U.S. Pat. No. 3,584,505 for Measuring Device For Monitoring Stresses of a Tool all disclose mechanisms for measuring the torques to which fasteners are tightened or devices which could be adopted to this application.

Fastener tools with torque measuring capabilities have heretofore tended to be too fragile to withstand the rough handling to which such tools are commonly subjected. These tools have also tended to be complex, bulky, expensive, and awkward to use or operate; and, in many cases, the torque measuring schemes would not produce accurate enough results to justify their added expense.

The novel torque measuring fastener tools I have invented are free of these disadvantages. They are rugged, and the torque measuring mechanisms are simple and accurate. The torque measuring mechanism does not add appreciably to the bulk or weight of the tool and does not make it awkward to use or otherwise interfere with its operation.

In my novel tools, a strain gage, load cell or other mechanical-to-electrical transducer is utilized to measure the angular deflection or displacement of a stationary component in the drive train connecting the tool motor to its rotary, fastener tightening output member or the lateral displacement of a sensing member connected to a rotatably mounted drive train component.

In both cases the displacement is directly proportional to the reaction or resistance torque exerted on the drive train component and, therefore, directly proportional to the torque to which the fastener is tightened.

The magnitude of the output from transducers such as those identified above and others which I may employ in the practice of the present invention is proportional to the deflection of the drive train component or the sensing member. Therefore, the magnitude of the transducer output signal reflects directly throughout the tightening operation the torque to which the fastener is tightened.

As suggested above, this signal can be used for at least two different purposes or for both of these. It can be employed to generate temporary indications and/or permanent records of the torque to which a fastener is tightened or simply that the fastener has been tightened to a torque within specified lower and upper limits. Also the transducer output signal can be employed to shut off the tool and terminate the tightening operation when the fastener has been tightened to the specified torque.

The primary object of the invention has been identified above. Other important but more specific objects of my invention reside in the provision of fastener tools in accord with the primary object which:

(1) are rugged and resistant to failure and loss of accuracy under the influence of rough handling;
(2) are relatively simple and inexpensive to manufacture and to service;
(3) are capable of measuring with a high degree of accuracy and reliability the torques to which fasteners are tightened by them;
(4) have torque measuring mechanisms that do not add appreciable weight or bulk or make the tool awkward to handle or otherwise interfere with its operation;
(5) have various combinations of the foregoing and other attributes which will become apparent hereinafter.

Other important objects and features and further advantages of the invention will be apparent from the appended claims and as the ensuing detailed description and discussion proceeds in conjunction with the accompanying drawing, in which:

Figure 1:
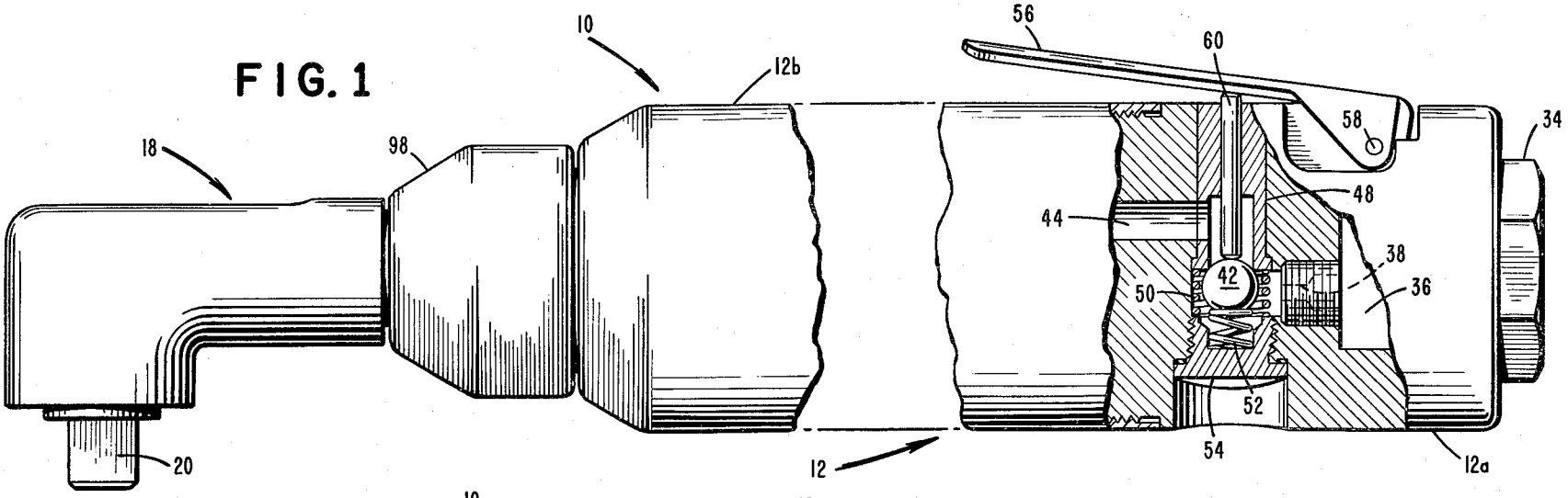
FIG. 1 is a partially sectioned side view of a fastener tightening tool embodying and constructed in accord with the principles of the present invention.
Figure 2:
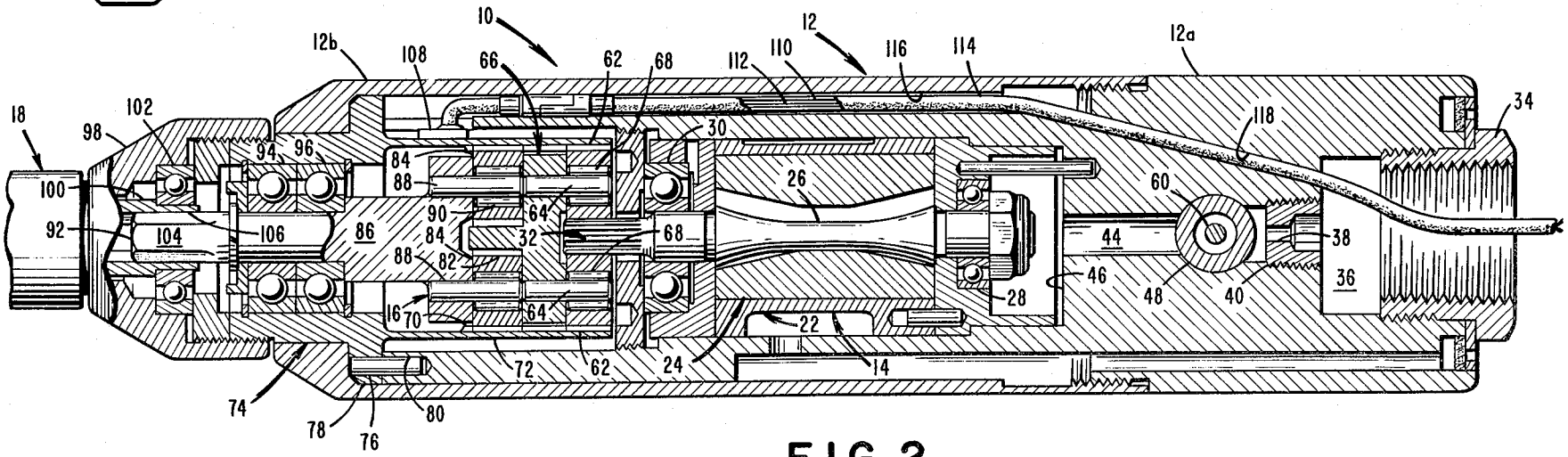
FIG. 2 is a partially sectioned plan view of the tool of FIG. 1.

Referring now to the drawing, FIGS. 1 and 2 depict a fastener tool 10 constructed in accord with and embodying the principles of the present invention. Tool 10 is a stall type nut runner.

As a fastener is tightened, its resistance to turning increases. In a stall type tool, this resistance or reaction torque is transmitted back through the drive train of the tool to its motor, progressively decreasing the motor speed until, as the fastener approaches the specified torque, the motor lugs and then stalls as this torque is reached.

Tool 10 includes a housing 12 surrounding an air motor 14. Motor 14 is connected through a double reduction planetary gear drive 16 and a bevel gear drive (not shown) in an angle head 18 to the rotatively mounted output member 20 of the tool. The output member is designed to have attached thereto a socket or other component engageable with the fasteners which the tool is being employed to tighten.

Nut runner 10 is in large part of a previously disclosed construction and will accordingly be described herein only to the extent necessary for the understanding of the present invention. Briefly, its air motor 14 includes a casing 22 in which a rotor 24 having a central shaft 26 is rotatably supported by bearings 28 and 30. An integral pinion 32 is formed on the left-hand end of shaft 26.

Air is supplied to motor 14 through a line (not shown) connected to a fitting 34 which is threaded into the rear end of casing component 12*a*. As shown in FIG. 1, the air flows from fitting 34 into a chamber 36 in component 12*a*, through an orifice 38 in an insert 40, around a valve member 42, and through passage 44 and chamber 46 into motor casing 22 to drive rotor 24.

Valve member 42 is both biased against a seat on an insert 48 at the inlet to passage 44 and laterally positioned by springs 50 and 52. The springs are kept in place by threaded retainer 54.

The valve member is displaced from the seated position to allow air to flow through passage 44 by depressing a lever 56 pivotally fixed to casing component 12*a* by pivot pin 58. Lever 56 abuts a plunger 60 slidably mounted in insert 48. When the lever is depressed toward casing 12, plunger 60 unseats the valve member. Subsequent release of the lever allows spring 52 to reseat valve member 42.

Referring again to FIG. 2, the pinion 32 on rotor shaft 26 of air motor 14 meshes with planet gears 62 of planetary drive train 16. The planet gears are rotatably supported on shafts 64 fixed to planet carrier 66 as by bearings 68. These gears also mesh with the teeth 70 of an internal ring gear 72 formed on elongated cylindrical member 74.

Member 74 abuts the left-hand end of casing section 12*a* and is prevented from rotating with respect to the casing by pins 76. The pins extend through a flange 78 on member 74 into blind apertures 80 in the casing section.

A pinion 82 is formed on the left-hand end of carrier 66. This pinion meshes with a second set of planet gears 84 rotatably supported from a second planet carrier 86 by shafts 88 and bearings 90. Planet gears 84 also mesh with the internal teeth 70 in ring gear 72.

Planet carrier 86 terminates in an elongated shaft 92, which is rotatably supported in ring gear member 74 by bearings 94 and 96. Shaft 92 is the output of reduction drive 16 and extends through component 74 to the exterior of casing 12.

Threaded onto component 74 is the casing 98 of angle head 18, which includes an input shaft 100 rotatably supported from casing 98 by bearing 102. Reduction drive shaft 92 extends into the right-hand end of shaft 100. Matching external and internal flats 104 and 106 rotatively couple the shafts.

Angle head input shaft 100 is connected through a pair of bevel gears (not shown) to output member 20, which is rotatably supported from angle head casing 98 by appropriate bearings (likewise not shown). The internal components of the angle head are illustrated and described in my copending U.S. Pat. application No. 104,209 filed Jan. 6, 1971, to which the reader may refer if desired.

As thus far described, tool 10 operates in the expected manner. Admission of air to motor 14 by depression of lever 56 causes the rotor 24 of the motor to rotate and pinion 32 to rotate planet gears 62 about shafts 64. As the latter mesh with internal gear 72, they travel in a circular path about the internal gear as they rotate. This turns carrier 66 and the pinion 82 formed on its left-hand end.

Pinion 82, in turn, rotates planet gears 84 about shafts 88; and the planet gears move in a circular path about the internal gear, rotating carrier 86 and the output shaft 92 formed on its left-hand end. The rotary motion of shaft 92 is transmitted by angle head input shaft 100 to output member 20 through the angle head drive train described previously and by the output member to the fastener being tightened.

As the fastener tightens, it generates a reaction or resistance torque which opposes the motor torque transmitted to output member 20. The reaction torque is transmitted by the drive train components in angle head 18 and gear reduction drive 16 to motor 14. Accordingly, as the tightening continues and the reaction torque increases, the differential between the reaction and drive forces decreases until they are equal. At this point the motor stalls and the tightening of the fastener is terminated.

The torque to which the fastener is tightened is dependent upon the pressure of the air supplied to tool 10. Fasteners can be tightened to selected torques with a high degree of accuracy by first calibrating the tool and then adjusting the pressure of the air supply so that the tool will stall when the fastener reaches design torque.

It is nevertheless desirable in many circumstances to measure the torque to which the fastener is tightened rather than assuming that calibration of the tool and adjustment of the air supply to a specified pressure will produce the desired degree of tightness.

In tool 10, the torque is measured by fixing a conventional strain gage transducer 108 to the exterior of the ring gear 72 in gear reduction drive 16. The strain gage is connected through leads 110 and 112 in cable 114 to opposite sides of a compatible power source (not shown) in conventional fashion.

Ring gear 72 is analagous to a cantilever beam because it is fixed against rotation in casing 12 towards its left-hand end. Accordingly, exertion of a rotary moment or torque on the right-hand portion of the ring gear will cause that portion of the gear to be angularly deflected. The magnitude of deflection is detected by the strain gage, and its resistance changes in proportion to the amount of deflection, producing a corresponding change in the magnitude of the voltage across the strain gage terminals.

The angular deflection of ring gear 72 is directly proportional to the resistance to turning of the fastener being tightened and, therefore, proportional to the torque to which the fastener is tightened. Consequently, the voltage across the strain gage terminals is also proportional to the torque to which the fastener is tightened.

As discussed previously, the output from or voltage across strain gage 108 may be employed to provide an indication of the torque to which the fastener is tightened during and/or at the termination of the tightening operation. This signal may also be used to terminate the tightening operation when the fastener has been tightened to the desired torque or for both of the foregoing purposes.

U.S. Pat. No. 3,710,874 for Electronic Torque Measurement System discloses circuitry which can be used for processing the output from transducer 108 to provide an indication and/or record of the measured torque. Other of the patents cited above disclose circuits which may alternately be employed for this purpose, and still others are well-known to those skilled in the relevant arts. Because suitable circuitry is well-known, and because the particular circuits employed are not part of the present invention, they will not be described further herein.

Similarly, there have heretofore been proposed a number of mechanisms by which an electrical signal such as that generated by strain gage 108 may be employed to interrupt the supply of air to motor 14 and terminate the tightening operation when the fastener has been tightened to the desired torque. An exemplary one of these which may be readily incorporated in tool 10 if it is desired to operate the latter as a shut-off rather than stall type tool is illustrated and described in the above-cited U.S. Pat. No. 3,572,447. Again, because suitable devices are known and because the particular one that is employed is not part of the present invention, the device has not been illustrated herein.

It will be apparent from the foregoing description and from the drawing that the goals of the present invention have been realized in tool 10. Strain gages are noted for their ruggedness; and, in tool 10, the strain gage is, further, encased within and protected by housing component 12*b*. Accordingly, it is not susceptible to failure or to loss of accuracy, even if tool 10 is roughly handled.

Additional protection against damage is provided by leading strain gage output cable 114 through air motor exhaust passage 116 and a passage 118 in casing component 12*a* into the air supply line of the tool. This also keeps all components of the torque measuring mechanism within housing 12. The mechanism does not alter the external configuration of the tool and therefore does not make it awkward to use or otherwise interfere with its operation.

The just described torque measuring mechanism is extremely simple. It is light, relatively inexpensive, and easily accessible for servicing, in the event that this should prove necessary.

Figure 3:
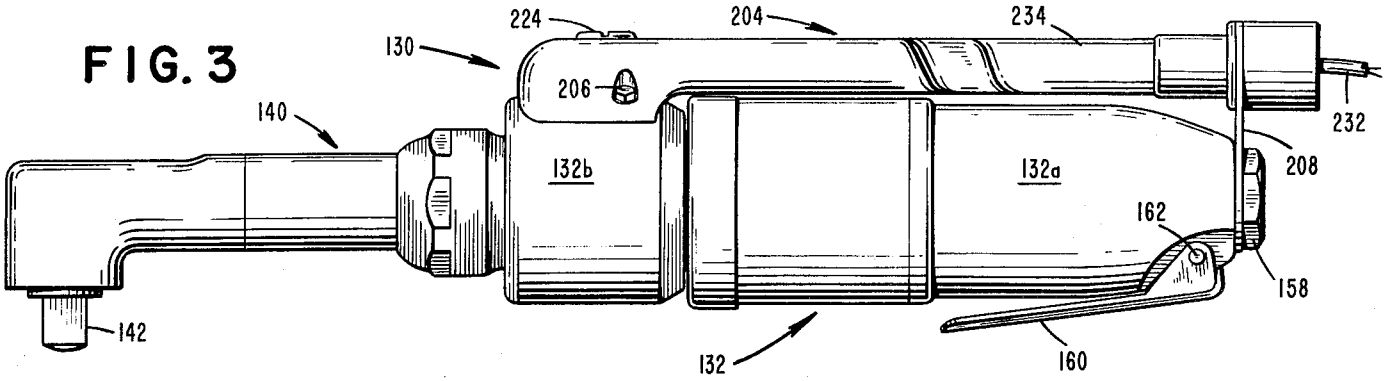
FIG. 3 is a side view of a second form of fastener tightening tool constructed in accord with and embodying the principles of the invention.
Figure 4:
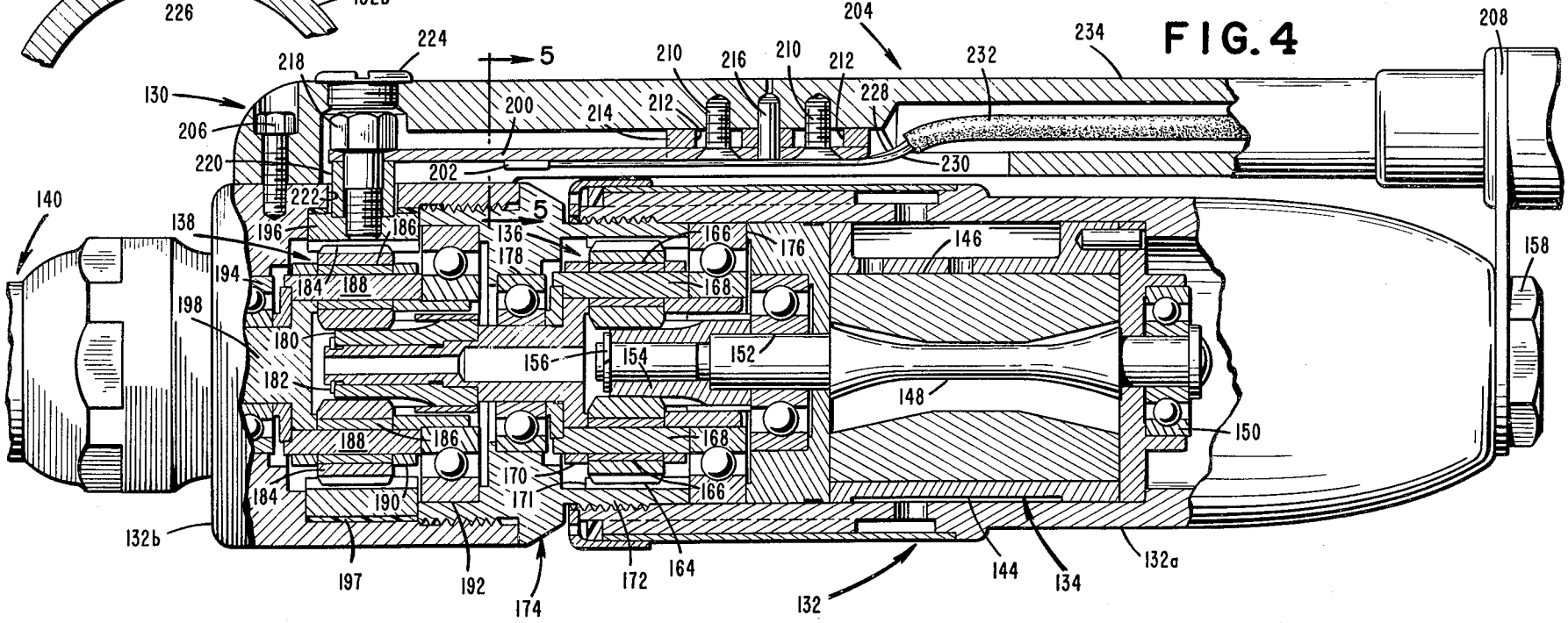
FIG. 4 is a partially sectioned fragment of FIG. 3 to an enlarged scale.
Figure 5:
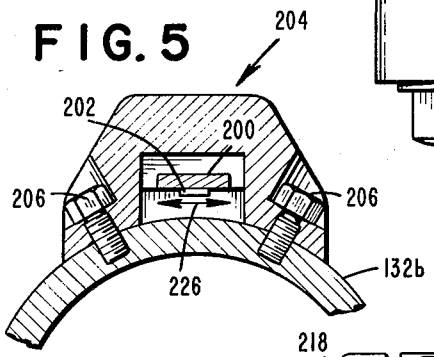
FIG. 5 is a partial section through the tool of FIG. 3, taken substantially along line 5—5 of FIG. 4.

Referring again to the drawing, FIGS. 3–5 illustrate a tool 130, also in accord with and embodying the principles of the invention. Tool 130 is also a stall type nut runner. It operates in generally the same manner as tool 10 although its appearance and internal components are somewhat different. Again, the conventional components of the tool will be described only to the extent necessary to provide an appreciation of the present invention.

Fastener tool 130 includes a casing 132 housing an air motor 134. The motor is connected through planetary gear drives 136 and 138 and a bevel gear drive (not shown) in angle head 140 to the rotatively mounted output member 142 of the tool. This output member is also designed to have a fastener engageable component attached to it.

Air motor 134 is similar to motor 14. It includes a casing 144 in which a rotor 146 having a central shaft 148 is rotatively supported by bearings 150 and 152. A pinion 154 is retained on the left-hand end of the shaft for rotation therewith by a snap-in retainer 156.

Air is supplied to motor 134 from a line (not shown) connected to a fitting 158 which is threaded into the rear end of casing 132. From this fitting, the air flows through the casing and then into motor casing 144 to drive rotor 146.

The flow of air to motor 134 is controlled by a lever 160 pivotally fixed to casing 132 by pivot pin 162 (see FIG. 3). When the lever is depressed toward the casing, it unseats the valve member (not shown), allowing air to flow to the motor. Subsequent release of the member allows the valve member to seat.

Referring again to FIG. 4, the pinion 154 fixed to air motor rotor shaft 148 meshes with planet gears 164 of the first planetary drive 136. Planet gears 164 are rotatably supported by bearings 166 from shafts 168 of planet carrier 170.

The planet gears mesh with the teeth 171 of an internal ring gear 172 formed on a member 174 threaded into casing section 132*a*. Bearings 176 and 178 mounted in member 174 and casing section 132*a*, respectively, rotatively support carrier 170 in casing 132.

A pinion 180 is fixed to the left-hand end of carrier 170 for rotation therewith by retainer 182. This pinion meshes with a second set of planet gears 184.

Planet gears 184 are supported by bearings 186 from shafts 188 of a second planet carrier 190. This carrier is rotatively supported in casing 132 by bearings 192 and 194 housed in member 174 and casing section 132*b*, respectively.

Planet gears 184 mesh with a second internal ring gear 196. This gear is freely rotatable in housing section 132*b* on a bearing 197 of Teflon or comparable low friction material.

Planet carrier 190 has an elongated shaft 198 which extends through casing component 132*a* to the exterior of the casing. Shaft 198 is coupled to an angle head input shaft which, in turn, is drive connected through a pair of bevel gears to output member 142. These internal components of angle head 140 (not shown) may also be as illustrated and described in my copending U.S. Pat. application No. 104,209.

As thus far described, tool 130 operates in a straightforward manner. Admission of air to motor 134 by depression of lever 160 causes the rotor 146 of the motor to rotate and pinion 154 to rotate planet gears 164 about shafts 168. As the pinions also mesh with stationary internal gear 172, they travel in a circular path about the internal gear, rotating carrier 170 and pinion 180.

Pinion 180, in turn, rotates planet gears 184 about shafts 188; and the planet gears roll around internal gear 196, which is constrained against more than limited movement relative to casing 132 in a manner and for reasons that will become apparent shortly. This rotates carrier 190 and the output shaft 198 formed on its left-hand end. This rotary motion is transmitted by drive train components in the angle head 140 to output member 142.

As in the case of tool 10, the reaction or resistance torque generated as a fastener is tightened is transmitted to output member 142 and through the drive train components in angle head 140 and gear reduction drives 138 and 136 to motor 134. Accordingly, the tightening continues and the reaction torque increases until the motor stalls.

A laterally deflectable or bendable, cantilevered sensing member 200 and a strain gage 202 fixed to the sensing member are employed to generate torque measurements in tool 130 (see FIGS. 4 and 5).

The sensing member and strain gage are encased in a housing 204 fixed, at one end, to tool housing component 132*b* as by fasteners 206. The opposite end of the housing is supported from the rear end of tool 130 by bracket 208.

One end of sensing member 200 is fixed to casing 204 by fasteners 210, which extend through the sensing member and elongated slots 212 in support bracket 214 and are threaded into the casing. The elongated slots are for adjustment or calibration of sensing member 200. After this is accomplished, the adjustment is maintained by inserting an aligning dowel 216 through the sensing member and bracket 214 into casing 204.

The opposite (left-hand as shown in FIG. 4) end of the sensing member is fixed to ring gear 196 by a fastener 218. The fastener extends through the sensing member and a sleeve 220 disposed in an opening 222 through tool housing component 132*b* and is threaded into the ring gear. A removable cap 224 threaded into casing member 204 affords access to fastener 218, when necessary.

As internal gear 196 is freely rotatable in tool housing 132, the reaction torque exerted upon it as a fastener is tightened is transmitted directly to sensing member 200 through fastener 218, exerting on the latter a lateral bending force (see arrow 226 in FIG. 5), which is proportional to the reaction torque and, therefore, to the torque to which the fastener is tightened. The magnitude of the lateral deflection is detected by strain gage 202. As in tool 10, the strain gage is connected across an electrical power source by conductors 228 and 230. Consequently, as the resistance of the strain gage changes, there is a corresponding change in the magnitude of the voltage across the strain gage terminals.

This voltage is directly proportional to the torque to which the fastener is tightened. The signal may be employed as discussed above in conjunction with tool 10 to provide an indication of the torque to which the fastener is tightened during and/or at the termination of the tightening operation and/or to shut off tool 130 when the fastener has been tightened to design torque or for all of these purposes.

The strain gage and sensing member are well protected against failure or loss of accuracy from rough handling of tool 130 by the housing 204 in which they are encased. The lead 232 in which conductors 228 and 230 are incorporated extends to the rear of the tool through a tubular portion 234 of this casing, also protecting the conductors against damage.

Although externally located, casing 204 does not interfere to an unacceptable extent with the handling or operation of the tool. Nor do it or the torque measuring components encased by it increase the complexity or weight of the tool to an unacceptable extent.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fastener tightening tool, comprising: a housing; a fastener rotating output member rotatably supported from said housing; a motor and a drive train connected thereto for rotating said output member, said drive train including an angularly deflectable torque sensing component; means fixing a first portion of said torque sensing component against rotation in said housing over the entire range of reaction torque exerted on said component during a fastener tightening operation; and means for measuring the angular deflection of a second portion of said component during a fastener tightening operation to thereby provide a measure of the torque in which the fastener is tightened.

2. A fastener tightening tool, comprising a housing; a fastener rotating output member rotatably supported from said housing; a motor and a drive train including an angularly deflectable internal gear for rotating said output member; means for restraining a first portion of said internal gear against rotation over the entire range of torques to which said internal gear is subjected during a fastener tightening operation; and means for measuring the angular deflection of a second portion of said internal gear during a fastener tightening operation to thereby provide a measure of the torque to which the fastener is tightened.

3. A fastener tightening tool, comprising: a housing; a fastener rotating output member rotatably supported from said housing; a motor and a drive train for rotating said output member, said drive train including a reaction torque responsive component and means fixing one end of said component against rotation relative to said housing with a portion thereof free for angular displacement relative to the housing; and means for measuring the angular displacement of said portion during a fastener tightening operation at a location removed from said one end of said component to thereby provide a measure of the torque to which the fastener is tightened.

4. The tool of claim 3, wherein said drive train component is an internal ring gear.

5. A fastener tightening tool, comprising: a housing; a fastener rotating output member rotatably supported from said housing; a motor and drive train for rotating said output member, said drive train including a component rotatable in said housing; an elongated, laterally deflectable, reaction torque responsive member separate from said drive train fixed relative to said housing and to said component at opposite ends thereof; and means for measuring the lateral deflection of said member during a fastener tightening operation to thereby provide a measure of the torque to which the fastener is tightened.

6. The tool of claim 5, wherein said rotatable drive train component is an internal ring gear.

7. The tool of claim 5, together with a low friction bearing member between said rotatable drive component and the housing to increase the freedom of rotation of said component relative to the housing.

8. The tool of claim 5, wherein the means of measuring the lateral deflection of the elongated, reaction torque responsive member comprises a means having an output which is varied by and in proportion to the deflection of said reaction torque responsive member.

9. A fastener tightening tool, comprising: a housing; a fastener rotating output member rotatably supported from said housing; a motor and a drive train for rotating said output member, said drive train including a component rotatable in said housing; torque measuring means including an elongated sensing member extending axially relative to said housing, one end of said member being fixed relative to said drive train component; means for adjusting the position of the opposite end of said elongated member relative to said housing; means for thereafter fixing said opposite end of said elongated member relative to said housing to retain it in the position to which it is adjusted; and means for measuring the lateral deflection of said elongated member during a fastener tightening operation to thereby provide a measure of the torque to which the fastener is tightened.

10. A fastener tightening tool, comprising: a housing; a fastener rotating output member rotatably supported from said housing; a motor and a drive train for rotating said output member, said drive train including a component rotatable in said housing; torque measuring means including an elongated sensing member extending axially along the exterior of said housing, one end of said member being fixed relative to said drive train component; means for making the opposite end of said elongated member stationary relative to said housing; means for measuring the lateral deflection of said elongated sensing member during a fastener tightening operation to thereby provide a measure of the torque to which the fastener is tightened; and an auxiliary housing fixed to and co-operating with said tool housing to surround said sensing member and protect it against damage.

11. The tool of claim 10, wherein the lateral deflection measuring means comprises a mechanical-to-electrical transducer operatively associated with said sensing member and an electrical conductor means electrically connected to said transducer, said transducer being adjacent one end of the tool and said electrical conductor means extending from adjacent said one end of the tool to the opposite end thereof through said auxiliary housing to thereby protect said conductor means against damage.

12. In a power tool including torque output means and a tool body having a motor therein and drive means connecting said motor with said torque output means, the improvement of torque sensing means including transducer means in said tool body and subjected to a reaction torque from a substantially stationary member of said drive means, said transducer means including an axially extending sleeve having one end fixed in said body, ring gear means carried at the other end of the sleeve, sensing means on said sleeve and spaced axially of said ring gear means for sensing torsional load on said ring gear means, said drive means including reduction gearing including said ring gear means, said reduction gearing being unsupported by said transducer means, said transducer means providing a signal proportional to the torque output of said torque output means, and means responsive to said control signal.

13. The power tool of claim 12, further characterized in that said sensing means comprises an electromechanical transducer.

14. The power tool of claim 13, further characterized in that said drive means comprises at least one planetary reduction gear train having at least one idler gear, said ring rear means meshing with said idler gear included in said reduction gearing.

15. The power tool of claim 14, further characterized in that said planetary reduction gear train includes two stages, and said transducer means is operatively associated with the ring gear of said second stage.

* * * * *